United States Patent [19]

Havel

[11] Patent Number: 4,771,274

[45] Date of Patent: Sep. 13, 1988

[54] VARIABLE COLOR DIGITAL DISPLAY DEVICE

[76] Inventor: Karel Havel, P.O. Box 66, Station M, Toronto, Ontario, Canada, M6S 4T2

[21] Appl. No.: 929,625

[22] Filed: Nov. 12, 1986

Related U.S. Application Data

[62] Division of Ser. No. 817,114, Jan. 8, 1986, Pat. No. 4,647,217.

[51] Int. Cl.[4] ..... G09G 3/14

[52] U.S. Cl. ..... 340/703; 340/762; 340/701

[58] Field of Search ..... 340/762, 804, 782, 701, 340/702, 703, 704, 815.1, 815.03

[56] References Cited

U.S. PATENT DOCUMENTS 3,924,227 12/1975 Stolov ..... 340/762
4,190,836 2/1980 Kimura et al. ..... 340/762
4,231,033 10/1980 Paphitis ..... 340/762
4,301,450 11/1981 Smoliar ..... 340/701
4,488,149 12/1984 Givens ..... 340/762

FOREIGN PATENT DOCUMENTS 3009416 9/1981 Fed. Rep. of Germany ..... 340/762
1528178 10/1978 United Kingdom .

OTHER PUBLICATIONS

"Digital Design", M. Morris Mano, Prentice-Hall, 1984, p. 243.

*Primary Examiner*—John W. Caldwell, Sr.
*Assistant Examiner*—Alvin Oberley

[57] ABSTRACT

A variable color display device simultaneously indicates values of first digital data in digital format and values of second digital data in variable color.

3 Claims, 4 Drawing Sheets

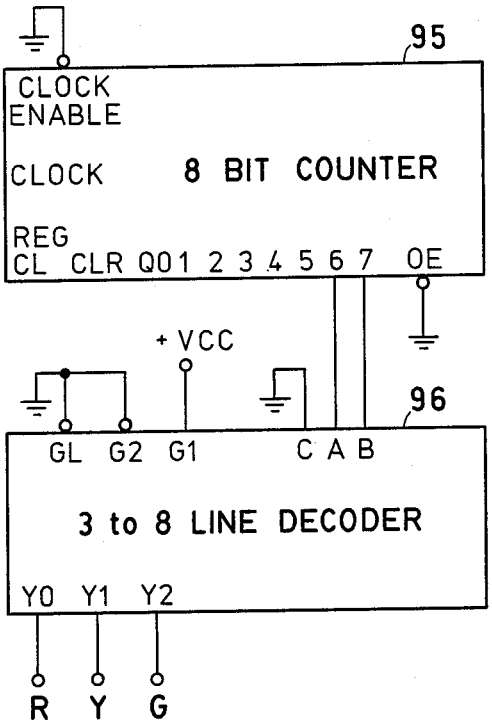
FIG. 7
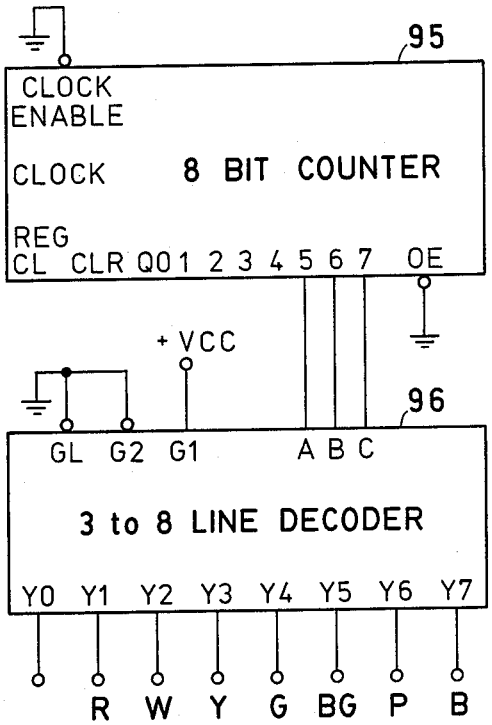
FIG. 9
| COUNT | COLOR |
|---|---|
| 128 to 191 | GREEN |
| 64 to 127 | YELLOW |
| < 63 | RED |
FIG. 8
| COUNT | COLOR |
|---|---|
| > 224 | BLUE |
| 192 to 223 | PURPLE |
| 160 to 191 | BLUE-GREEN |
| 128 to 159 | GREEN |
| 96 to 127 | YELLOW |
| 64 to 95 | WHITE |
| 32 to 63 | RED |
FIG. 10

VARIABLE COLOR DIGITAL DISPLAY DEVICE

CROSS-REFERENCE TO RELATED APPLICATIONS

This is a division of my copending applicatione Ser. No. 06/817,114, filed on Jan. 8, 1986, entitled Variable Color Digital Timepiece, now U.S. Pat. No. 4,647,217, issued on Mar. 3, 1987.

BACKGROUND OF THE INVENTION

1. Field of the Invention

This invention relates to variable color display devices.

2. Description of the Prior Art

A display device that can change color and selectively display characters is described in my U.S. Pat. No. 4,086,514, entitled Variable Color Display Device and issued on Apr. 25, 1978. This display device includes display areas arranged in a suitable font, such as well known 7-segment font, which may be selectively energized in groups to display all known characters. Each display area includes three light emitting diodes for emitting light signals of respectively different primary colors, which are blended within the display area to form a composite light signal. The color of the composite light signal can be controlled by selectively varying the portions of the primary light signals.

Commercially available monochromatic display devices are not capable of simultaneously indicating values of two sets of digital data.

SUMMARY OF THE INVENTION

It is the principal object of this invention to provide a variable color display device for simultaneously indicating values of first digital data in a character format and values of second digital data in variable color.

In summary, a display device of the present invention is provided with a variable color display for indicating values of digital data from a first digital device in a character format. Color control circuits are provided for controlling color of the display in accordance with values of digital data from a second digital device.

BRIEF DESCRIPTION OF THE DRAWINGS

In the drawings in which are shown several embodiments of the invention,

FIG. 7 is a schematic diagram of a counter and decoder combination for developing color control signals for the display element in FIG. 3.

FIG. 8 is a chart showing the relationship between count accumulated in the counter in FIG. 7 and color of the display element in FIG. 3.

FIG. 9 is a schematic diagram of a counter and decoder combination for developing color control signals for the display element in FIG. 5.

FIG. 10 is a chart showing the relationship between count accumulated in the counter in FIG. 9 and color of the display element in FIG. 5.

Throughout the drawings, like characters indicate like parts.

DESCRIPTION OF THE PREFERRED EMBODIMENTS

Figure 1:
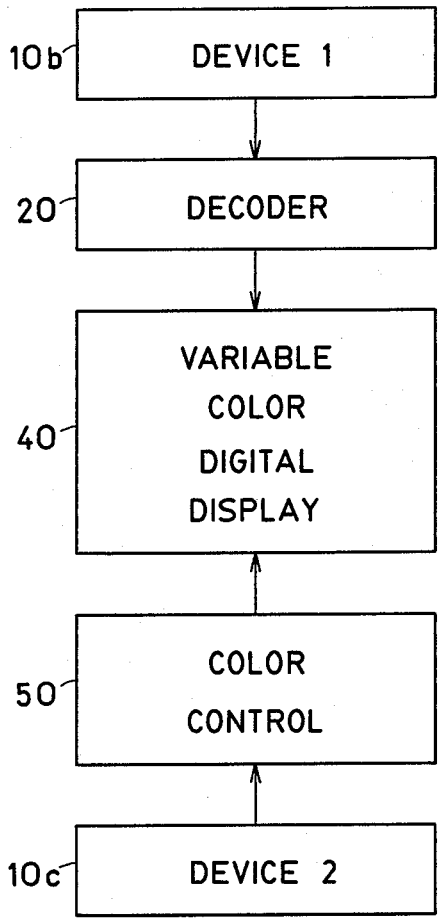
FIG. 1 is a block diagram of a variable color digital display device of the present invention.

Referring now, more particularly, to the drawings, in FIG. 1 is shown a block diagram of a display device of the present invention which includes a device 10*b* for developing digital data, a suitable decoder 20 for converting the data into a displayable code, and a variable color digital display 40 for indicating the data in a character format. The invention resides in the addition of a second device 10*c* for developing digital data and color control 50 for controlling color of the display 40 in accordance with the data developed by the device 10*c*. The variable color display system of the invention can thus simultaneously indicate values of digital data from two devices, by causing values of data from the first device to be indicated on the display in a character format and by controlling color of the display in accordance with values of data from the second device.

Figure 2:
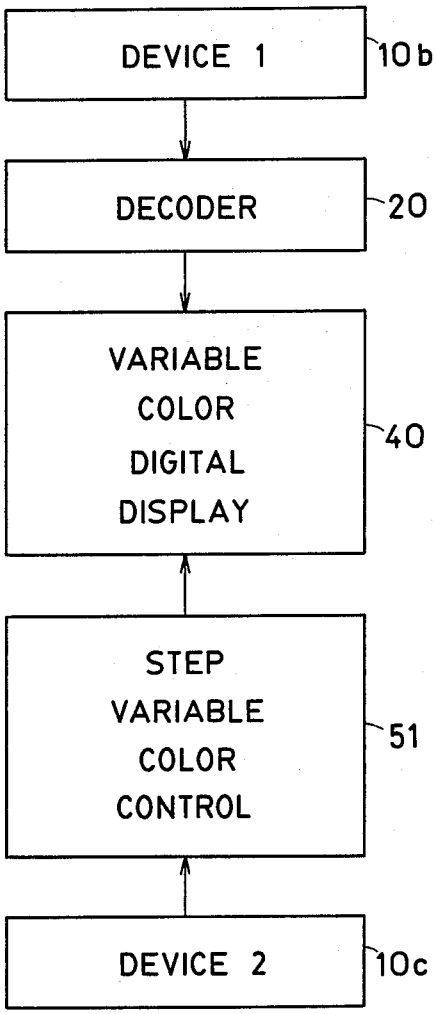
FIG. 2 is a block diagram of a step variable color digital display device.

In FIG. 2 is shown a block diagram of a modified variable color display device characterized by a step variable color control 51 for controlling color of the display 40 in a plurality of steps in accordance with data from the device 10*c*.

It will be recalled that digital data are usually comprised of series of binary codes which may be electrically represented by two different voltages referred to as low and high logic levels. A device for developing digital data may have characteristics of a counter, flip-flop, decoder, encoder, shift register, memory, latch, logic network, microprocessor, microcomputer, or the like.

Figure 3:
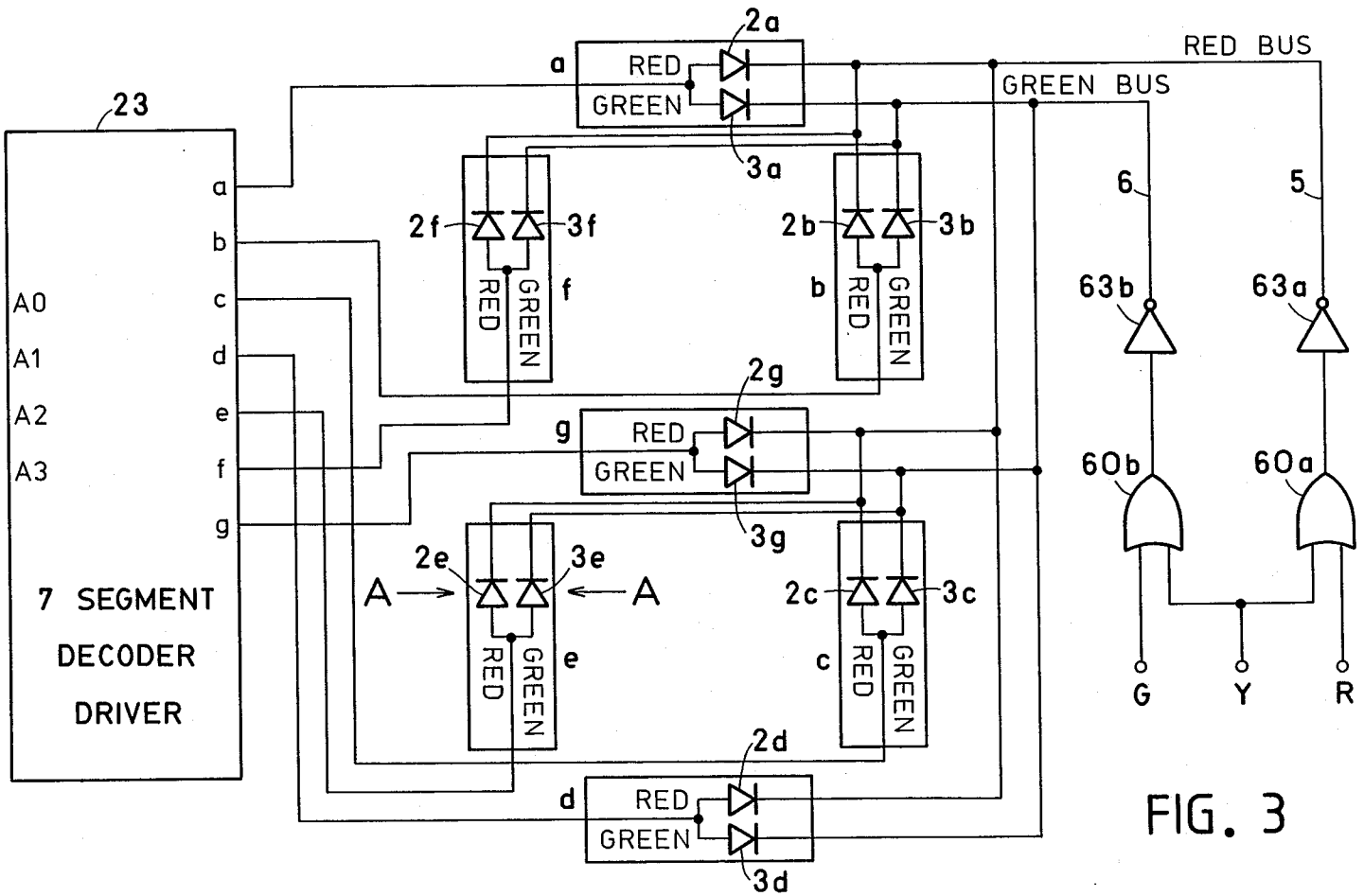
FIG. 3 is a schematic diagram of 2-primary color display element.

In FIG. 3 is shown a schematic diagram of a one-character 2-primary color common cathodes 7-segment display element which can selectively display various digital fonts in different colors. The display element includes seven elongated display segments a, b, c, d, e, f, g, arranged in a conventional pattern, which may be selectively energized in different combinations to display desired digits. Each display segment includes a pair of LEDs (light emitting diodes): a red LED 2 and green LED 3, which are closely adjacent such that the light signals emitted therefrom are substantially superimposed upon each other to mix the colors. To facilitate the illustration, the LEDs are designated by segment symbols, e. g., the red LED in the segment a is designated as 2*a*, etc. The anodes of all red and green LED pairs are interconnected in each display segment and are electrically connected to respective outputs of a commercially well known common-cathode 7-segment decoder driver 23. The cathodes of all red LEDs 2*a*, 2*b*, 2*c*, 2*d*, 2*e*, 2*f*, and 2*g* are interconnected to a common electric path referred to as a red bus 5. The cathodes of all green LEDs 3*a*, 3*b*, 3*c*, 3*d*, 3*e*, 3*f*, and 3*g* are interconnected to a like common electric path referred to as a green bus 6. As will be more fully pointed out subsequently, color of the display element may be controlled by applying proper combinations of logic level signals to color control inputs R (red), Y (yellow), and G (green).

Figure 4:
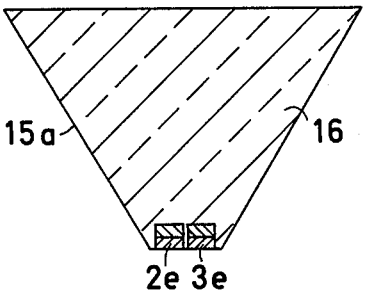
FIG. 4 is an enlarged cross-sectional view of one display segment in FIG. 3, taken along the line A—A.

In FIG. 4, red LED 2*e* and green LED 3*e* are placed on the base of the segment body 15*a* which is filled with transparent light scattering material 16. When forwardly biased, the LEDs 2*e* and 3*e* emit light signals of red and green colors, respectively, which are scattered within the transparent material 16, thereby blending the red and green light signals into a composite light signal that emerges at the upper surface of the segment body 15*a*. The color of the composite light signal may be controlled by varying portions of the red and green light signals.

Figure 5:
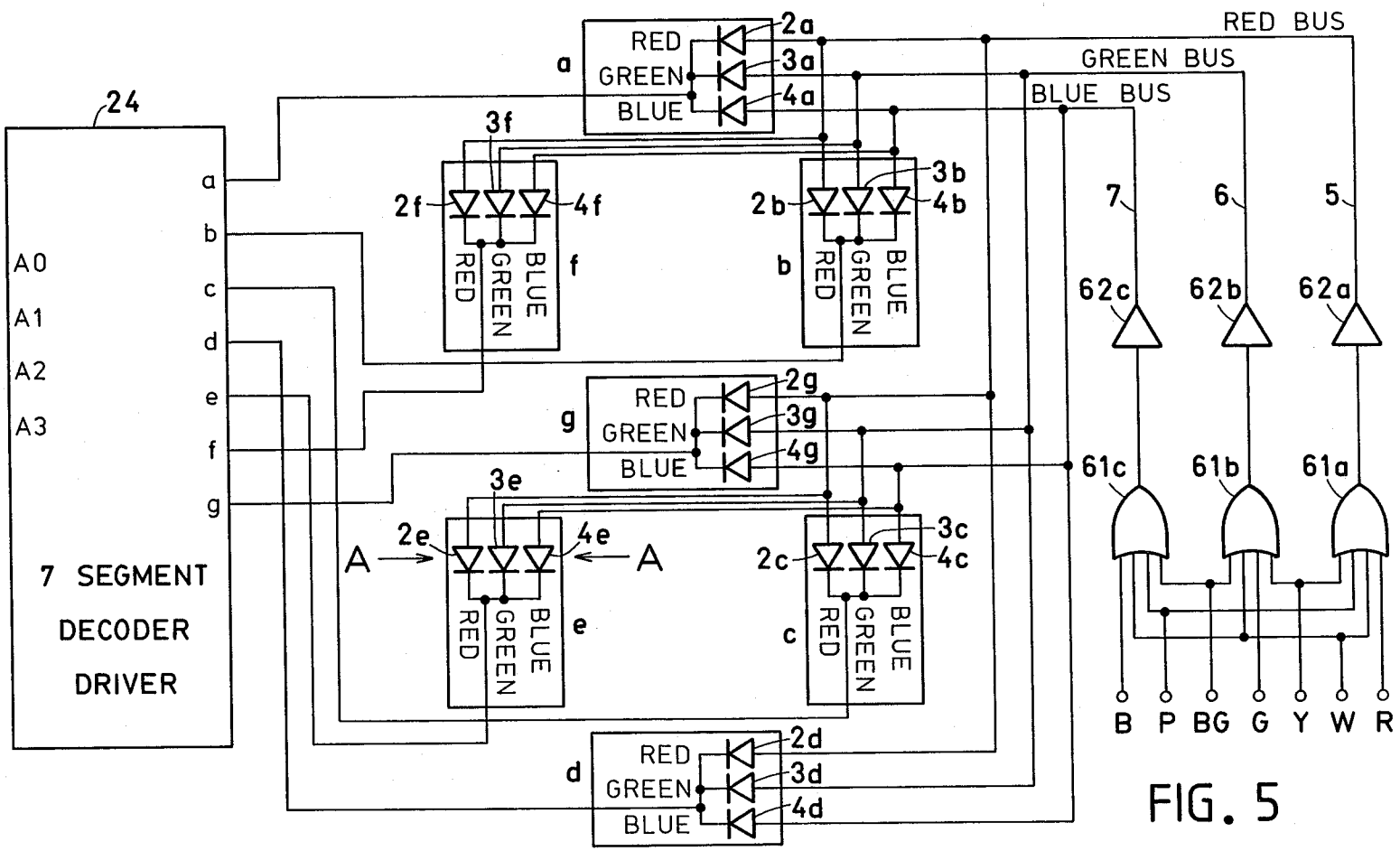
FIG. 5 is a schematic diagram of 3-primary color display element.

In FIG. 5 is shown a schematic diagram of a one-character 3-primary color common anodes 7-segment display element which can selectively display digital fonts in different colors. Each display segment of the display element includes a triad of LEDs: a red LED 2, green LED 3, and blue LED 4, which are closely adjacent such that the light signals emitted therefrom are substantially superimposed upon one another to mix the colors. The cathodes of all red, green, and blue LED triads in each display segment are interconnected and electrically connected to respective outputs of a commercially well known common anode 7-segment decoder driver 24. The anodes of all red LEDs 2*a*, 2*b*, 2*c*, 2*d*, 2*e*, 2*f*, 2*g* are interconnected to form a common electric path referred to as a red bus 5. The anodes of all green LEDs 3*a*, 3*b*, 3*c*, 3*d*, 3*e*, 3*f*, 3*g* are interconnected to form a like common electric path referred to as a green bus 6. The anodes of all blue LEDs 4*a*, 4*b*, 4*c*, 4*d*, 4*e*, 4*f*, 4*g* are interconnected to form a like common electric path referred to as a blue bus 7. As will be more fully pointed out subsequently, color of the display element may be controlled by applying proper combinations of logic level signals to color control inputs R (red), W (white), Y (yellow), G (green), BG (blue-green), P (purple), and B (blue).

Figure 6:
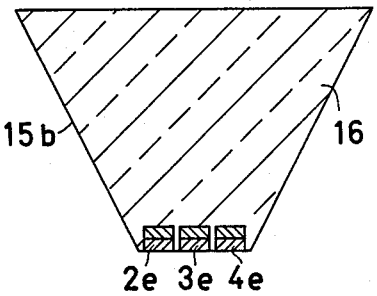
FIG. 6 is an enlarged cross-sectional view of one display segment in FIG. 5, taken along the line A—A.

In FIG. 6, red LED 2*e*, green LED 3*e*, and blue LED 4*e* are placed on the base of the segment body 15*b* which is filled with transparent light scattering material 16. Red LEDs are typically manufactured by diffusing a p-n junction into a GaAsP epitaxial layer on a GaAs substrate; green LEDs typically use a GaP epitaxial layer on a GaP substrate; blue LEDs are typically made from SiC material.

When forwardly biased, the LEDs 2*e*, 3*e*, and 4*e* emit light signals of red, green, and blue colors, respectively, which are scattered within the transparent material 16, thereby blending the red, green, and blue light signals into a composite light signal that emerges at the upper surface of the segment body 15*b*. The color of the composite light signal may be controlled by varying portions of the red, green, and blue light signals.

STEP VARIABLE COLOR CONTROL

By referring again to FIG. 3, the operation of the 2-primary color 7-segment display will be explained on example of illuminating digit '7' in three different colors. Any digit between 0 and 9 can be selectively displayed by applying the appropriate BCD code to the inputs A0, A1, A2, A3 of the common-cathode 7-segment decoder driver 23. The decoder 23 develops at its outputs a, b, c, d, e, f, and g drive signals for energizing selected groups of the segments to visually display the selected number, in a manner well known to those having ordinary skill in the art. To display decimal number '7', a BCD code 0111 is applied to the inputs A0, A1, A2, A3. The decoder 23 develops high voltage levels at its outputs a, b, c, to illuminate respective segments a, b, c, and low voltage levels at all remaining outputs, to extinguish all remaining segments.

To illuminate the display in red color, the color control input R is raised to a high logic level and color control inputs Y and G are maintained at a low logic level. As a result, the output of an OR gate 60*a* rises to a high logic level, thereby forcing the output of an inverting buffer 63*a* to drop to a low logic level. The current flows from the output a of the decoder 23, via red LED 2*a* and red bus 5, to the current sinking output of the buffer 63*a*. Similarly, the current flows from the output b of the decoder 23, via red LED 2*b* and red bus 5, to the output of the buffer 63*a*. The current flows from the output c of the decoder 23, via red LED 2*c* and red bus 5, to the output of the buffer 63*a*. As a result, the segments a, b, c illuminate in red color, thereby causing a visual impression of a character '7'. The green LEDs 3*a*, 3*b*, 3*c* remain extinguished because the output of the buffer 63*b* is at a high logic level, thereby disabling the green bus 6.

To illuminate the display in green color, the color control input G is raised to a high logic level, while the color control inputs R and Y are maintained at a low logic level. As a result, the output of an OR gate 60*b* rises to a high logic level, thereby forcing the output of an inverting buffer 63*b* to drop to a low logic level. The current flows from the output a of the decoder 23, via green LED 3*a* and green bus 6, to the current sinking output of the buffer 63*b*. Similarly, the current flows from the output b of the decoder 23, via green LED 3*b* and green bus 6, to the output of the buffer 63*b*. The current flows from the output c of the decoder 23, via green LED 3*c* and green bus 6, to the output of the buffer 63*b*. As a result, the segments a, b, c illuminate in green color. The red LEDs 2*a*, 2*b*, 2*c* remain extinguished because the output of the buffer 63*a* is at a high logic level, thereby disabling the red bus 5.

To illuminate the display in yellow color, the color control input Y is raised to a high logic level, while the color control inputs R and G are maintained at a low logic level. As a result, the outputs of both OR gates 60*a*, 60*b* rise to a high logic level, thereby forcing the outputs of both buffers 63*a*, 63*b* to drop to a low logic level. The current flows from the output a of the decoder 23, via red LED 2*a* and red bus 5, to the current sinking output of the buffer 63*a*, and, via green LED 3*a* and green bus 6, to the current sinking output of the buffer 63*b*. Similarly, the current flows from the output b of the decoder 23, via red LED 2*b* and red bus 5, to the output of the buffer 63*a*, and, via green LED 3*b* and green bus 6, to the output of the buffer 63*b*. The current flows from the output c of the decoder 23, via red LED 2*c* and red bus 5, to the output of the buffer 63*a*, and, via green LED 3*c* and green bus 6, to the output of the buffer 63*b*. As a result of blending light of red and green colors in each segment, the segments a, b, c illuminate in substantially yellow color.

Turning again to FIG. 5, the operation of the 3-primary color 7-segment display will be explained on example of illuminating digit '1' in seven different colors. To display decimal number '1', a BCD code 0001 is applied to the inputs A0, A1, A2, A3 of a common anode 7-segment decoder driver 24. The decoder 24 develops low voltage levels at its outputs b, c, to illuminate the segments b, c, and high voltage levels at all remaining outputs, to extinguish all remaining segments.

To illuminate the display in red color, the color control input R is raised to a high logic level, while all remaining color control inputs are maintained at a low logic level. As a result, the output of an OR gate 61*a* rises to a high logic level, thereby forcing the output of a non-inverting buffer 62*a* to rise to a high logic level. The current flows from the output of the buffer 62*a*, via red bus 5 and red LED 2*b*, to the output b of the decoder 24, and, via red LED 2*c*, to the output c of the decoder 24. As a result, the segments b, c illuminate in red color, thereby causing a visual impression of a character '1'. The green LEDs 3*b*, 3*c* and blue LEDs 4*b*, 4*c* remain extinguished because the green bus 6 and blue bus 7 are disabled.

To illuminate the display in green color, the color control input G is raised to a high logic level, while all remaining color control inputs are maintained at a low logic level. As a result, the output of an OR gate 61*b* rises to a high logic level, thereby forcing the output of a non-inverting buffer 62*b* to rise to a high logic level. The current flows from the output of the buffer 62*b*, via green bus 6 and green LED 3*b*, to the output b of the decoder 24, and, via green LED 3*c*, to the output c of the decoder 24. As a result, the segments b, c illuminate in green color.

To illuminate the display in blue color, the color control input B is raised to a high logic level, while all remaining color control inputs are maintained at a low logic level. As a result, the output of an OR gate 61c rises to a high logic level, thereby forcing the output of a non-inverting buffer 62*c* to rise to a high logic level. The current flows from the output of the buffer 62*c*, via blue bus 7 and blue LED 4*b*, to the output b of the decoder 24, and, via blue LED 4*c*, to the output c of the decoder 24. As a result, the segments b, c illuminate in blue color.

To illuminate the display in yellow color, the color control input Y is raised to a high logic level, while all remaining color control inputs are maintained at a low logic level. As a result, the outputs of the OR gates 61*a*, 61*b* rise to a high logic level, thereby causing the outputs of the buffers 62*a*, 62*b* to rise to a high logic level. The current flows from the output of the buffer 62*a*, via red bus 5 and red LED 2*b*, to the output b of the decoder 24, and, via red LED 2*c*, to the output c of the decoder 24. The current also flows from the output of the buffer 62*b*, via green bus 6 and green LED 3*b*, to the output b of the decoder 24, and, via green LED 3*c*, to the output c of the decoder 24. As a result of blending light of red and green colors in each segment, the segments b, c illuminate in substantially yellow color.

To illuminate the display in purple color, the color control input P is raised to a high logic level, while all remaining color control inputs are maintained at a low logic level. As a result, the outputs of the OR gates 61*a*, 61*c* rise to a high logic level, thereby forcing the outputs of the buffers 62*a*, 62*c* to rise to a high logic level. The current flows from the output of the buffer 62*a*, via red bus 5 and red LED 2*b*, to the output b of the decoder 24, and, via red LED 2*c*, to the output c of the decoder 24. The current also flows from the output of the buffer 62*c*, via blue bus 7 and blue LED 4*b*, to the output b of the decoder 24, and, via blue LED 4*c*, to the output c of the decoder 24. As a result of blending light of red and blue colors in each segment, the segments b, c illuminate in substantially purple color.

To illuminate the display in blue-green color, the color control input BG is raised to a high logic level, while all remaining color control inputs are maintained at a low logic level. As a result, the outputs of the OR gates 61*b*, 61*c* rise to a high logic level, thereby forcing the outputs of the buffers 62*b*, 62*c* to rise to a high logic level. The current flows from the output of the buffer 62*b*, via green bus 6 and green LED 3*b*, to the output b of the decoder 24, and, via green LED 3*c*, to the output c of the decoder 24. The current also flows from the output of the buffer 62*c*, via blue bus 7 and blue LED 4*b*, to the output b of the decoder 24, and, via blue LED 4*c*, to the output c of the decoder 24. As a result of blending light of green and blue colors in each segment, the segments b, c illuminate in substantially blue-green color.

To illuminate the display in white color, the color control input W is raised to a high logic level, while all remaining color control inputs are maintained at a low logic level. As a result, the outputs of the OR gates 61*a*, 61*b*, 61*c* rise to a high logic level, thereby forcing the outputs of the buffers 62*a*, 62*b*, 62*c* to rise to a high logic level. The current flows from the output of the buffer 62*a*, via red bus 5 and red LED 2*b*, to the output b of the decoder 24, and, via red LED 2*c*, to the output c of the decoder 24. The current also flows from the output of the buffer 62*b*, via green bus 6 and green LED 3*b*, to the output b of the decoder 24, and, via green LED 3*c*, to the output c of the decoder 24. The current also flows from the output of the buffer 62*c*, via blue bus 7 and blue LED 4*b*, to the output b of the decoder 24, and, via blue LED 4*c*, to the output c of the decoder 24. As a result of blending light of red, green, and blue colors in each segment, the segments b, c illuminate in substantially white color.

Since the outputs of the 7-segment decoder 24 may be overloaded by driving a triad of LEDs in parallel in a variable color display, rather than a single LED in a monochromatic display, it would be obvious to employ suitable buffers to drive respective color display segments (not shown). It would be also obvious to provide current limiting resistors to constrain current through the LEDs (not shown).

COLOR CONTROL SIGNALS

In FIG. 7 is shown a detail of a counter and decoder combination for developing color control signals to cause the display to illuminate in one of three possible colors in accordance with the accumulated count. The description of the circuit should be considered together with its associated chart shown in FIG. 8. An 8-bit binary counter 95 contains internal register with outputs Q0 to Q7 available. Two most significant outputs Q6 and Q7 are connected to respective inputs A and B of a 3-to-8 line decoder 96; the decoder's most significant input C is grounded. In response to conditions of the counter outputs Q6 and Q7, the decoder 96 develops output signals Y0, Y1, and Y2. When both counter outputs Q6 and Q7 are at a low logic level (which is typical for counts less than 63), the output Y0 rises to a high logic level to generate active color control signal R (red). When the counter output Q6 rises to a high logic level, while the output Q7 is low (which is typical for counts between 64 and 127), the decoder output Y1 rises to a high logic level to generate active color control signal Y (yellow). When the counter output Q7 rises to a high logic level and Q6 drops to a low logic level (which is typical for counts between 128 and 191), the decoder output Y2 rises to a high logic level to generate active color control signal G (green). The decoder outputs may be respectively connected to like inputs of the display in FIG. 3.

Although not illustrated, it would be obvious that the counter may be incremented by applying suitable clock signals to its CLOCK input and initialized by applying a suitable signal to its CLR input. The accumulated count may be transferred to its internal register by applying a suitable signal to its REG CL input.

FIG. 9 is a like detail of a counter and decoder combination for developing color control signals to cause the display to illuminate in one of seven possible colors, depending on the accumulated count. The associated chart is shown in FIG. 10. This circuit differs from the one shown in FIG. 7 in that three outputs Q5, Q6, and Q7 of the counter 95 are connected to respective inputs A, B, and C of the decoder 96 to develop color control signals R, W, Y, G, BG, P, and B at respective decoder outputs Y1 to Y7. When the counter output Q5 is at a high logic level and Q6, Q7 are low (which is typical for counts between 32 and 63), the decoder output Y1 rises to a high logic level to generate active color control signal R (red). When the counter output Q6 is at a high logic level and Q5, Q7 are low (which is typical for counts between 64 and 95), the decoder output Y2 rises to a high logic level to generate active color control signal W (white). When the counter outputs Q5, Q6 are at a high logic level and Q7 is low (which is typical for counts between 96 and 127), the decoder output Y3 rises to a high logic level to generate active color control signal Y (yellow). When the counter output Q7 is at a high logic level and Q5, Q6 are low (which is typical for counts between 128 and 159), the decoder output Y4 rises to a high logic level to generate active color control signal G (green). When the counter outputs Q5, Q7 are at a high logic level and Q6 is low (which is typical for counts between 160 and 191), the decoder output Y5 rises to a high logic level to generate active color control signal BG (blue-green). When the counter outputs Q6, Q7 are at a high logic level and Q5 is low (which is typical for counts between 192 and 223), the decoder output Y6 rises to a high logic level to generate active color control signal P (purple). When all counter outputs Q5, Q6, Q7 are at a high logic level (which is typical for counts higher than 224), the decoder output Y7 rises to a high logic level to generate active color control signal B (blue). The decoder outputs may be respectively connected to like inputs of the display in FIG. 5.

It would be obvious that the color sequences could be readily changed by differently interconnecting outputs of the decoder with color control inputs of the display element.

In brief summary, the invention describes a method of simultaneously indicating values of first and second digital data, on a single variable color character display device, by causing values of the first data to be indicated on the display device in a character format and by controlling color of the display device in accordance with values of the second data.

A variable color display device was disclosed which is capable of simultaneously indicating values of digital data from two digital devices. Data from the first device are indicated on the display device in a character format. Color control is provided for controlling color of the display in accordance with data from the second device.

All matter herein described and illustrated in the accompanying drawings should be interpreted as illustrative and not in a limiting sense. It would be obvious that numerous modifications can be made in the construction of the preferred embodiments shown herein, without departing from the spirit of the invention as defined in the appended claims. It is contemplated that the principles of the invention may be also applied to numerous diverse types of display devices, such are liquid crystal, plasma devices, and the like.

CORRELATION TABLE

This is a correlation table of reference characters used in the drawings herein, their descriptions, and examples of commercially available parts.

| # | DESCRIPTION | EXAMPLE |
|---|---|---|
| 2 | red LED | |
| 3 | green LED | |
| 4 | blue LED | |
| 5 | red bus | |
| 6 | green bus | |
| 7 | blue bus | |
| 10 | device for developing digital data | |
| 15 | segment body | |
| 16 | light scattering material | |
| 20 | decoder | |
| 23 | common cathode 7-segment decoder | 74LS49 |
| 24 | common anode 7-segment decoder | 74LS47 |
| 40 | variable color digital display | |
| 50 | color control | |
| 51 | step variable color control | |
| 60 | 2-input OR gate | 74HC32 |
| 61 | 4-input OR gate | 4072 |
| 62 | non-inverting buffer | 74LS244 |
| 63 | inverting buffer | 74LS240 |
| 95 | 8-bit counter with register | 74HC590 |
| 96 | 3-to-8 line decoder | 74HC237 |

What I claim is:

1. A display device comprising:

variable color display means for providing a display indication in a single selective color;

an 8-bit binary counter for accumulating a count, said counter having counter outputs indicative of the value of the accumulated count;

a decoder responsive to said counter outputs for decoding said value of the accumulated count to color control signals, said decoder developing a first color control signal for said value of the accumulated count being less than 63, a second color control signal for said value of the accumulated count being between 64 and 127, and a third color control signal for said value of the accumulated count being between 128 and 191; and color control means responsive to said color control signals for causing said display means to illuminate in red color in response to said first color control signal, in yellow color in response to said second color control signal, and in green color in response to said third color control signal.

2. A display device comprising:

variable color display means for providing a display indication in a single selective color;

an 8-bit binary counter for accumulating a count, said counter having counter outputs indicative of the value of the accumulated count;

a decoder responsive to said counter outputs for decoding said value of the accumulated count to color control signals, said decoder developing a first color control signal for said value of the accumulated count being between 32 and 63, a second color control signal for said value of the accumulated count being between 64 and 95, a third color control signal for said value of the accumulated count being between 96 and 127, a fourth color control signal for said value of the accumulated count being between 128 and 159, a fifth color control signal for said value of the accumulated count being between 160 and 191, a sixth color control signal for said value of the accumulated count being between 192 and 223, and a seventh color control signal for said value of the accumulated count being over 224; and color control means responsive to said color control signals for causing said display means to illuminate in red color in response to said first color control signal, in white color in response to said second color control signal, in yellow color in response to said third color control signal, in green color in response to said fourth color control signal, in blue-green color in response to said fifth color control signal, in purple color in response to said sixth color control signal, and in blue color in response to said seventh color control signal.

3. A display device comprising:

variable color display means for providing a display indication in a single selective color;

an N-bit counter for accumulating a count, where N is an integer having value at least 2, said counter having counter outputs indicative of the value of the accumulated count;

a converter responsive to said counter outputs for converting said value of the accumulated count to color control signals, said converter developing a first color control signal for said value of the accumulated count being less than a predetermined low count, a second color control signal for said value of the accumulated count being between the predetermined low count and a predetermined high count, and a third color control signal for said value of the accumulated count being greater than the predetermined high count; and color control means responsive to said color control signals for causing said display means to illuminate in a first color in response to said first color control signal, in a second color in response to said second color control signal, and in a third color in response to said third color control signal.

* * * * *